United States Patent [19]

Reba

[11] 4,147,287

[45] Apr. 3, 1979

[54] REEL THREADING SYSTEM

[75] Inventor: Imants Reba, Vancouver, Wash.

[73] Assignee: Crown Zellerbach Corporation, San Francisco, Calif.

[21] Appl. No.: 866,980

[22] Filed: Jan. 5, 1978

[51] Int. Cl.[2] ..... B65H 25/06

[52] U.S. Cl. ..... 226/7; 226/91; 226/97

[58] Field of Search ..... 226/7, 97, 91

[56] References Cited

U.S. PATENT DOCUMENTS 3,844,189 10/1974 Jardine ..... 226/97

*Primary Examiner*—Allen N. Knowles

*Attorney, Agent, or Firm*—Thomas R. Lampe

[57] ABSTRACT

In a web reel system including a rotatable reel drum and reel spool, the improvement comprising reel threading means operatively associated with the spool and drum and including at least one Coanda nozzle adapted to induce a gaseous flow about the periphery of the drum for entraining a web introduced into the gaseous flow and directing same between the drum and the spool.

7 Claims, 3 Drawing Figures

REEL THREADING SYSTEM

BACKGROUND OF THE INVENTION

A number of systems are disclosed in the prior art for directing a moving web to a predetermined location such as into threading engagement with rolls forming a nip or the like. Examples of such systems are those disclosed in U.S. Pat. Nos. 3,999,696 and 4,014,487 wherein a gas such as air is directed through a restricted opening under pressure whereupon it attaches itself to a flow attachment surface due to the "Coanda effect", is directed to the predetermined location and entrains ambient air. The web is placed into the path of the moving gas and entrained thereby. The gas is moving at a velocity greater than the velocity of the moving web and thus the web is straightened out and directed to the predetermined location.

While the arrangements illustrated in the aforesaid patents are suitable for use in the vast majority of operational environments, reel threading presents entirely different problems than the usual situation where a web is delivered from a dryer roll or the like and guided into a predetermined location essentially in line with the threading system. The problem of reel threading becomes particularly aggravated when a break has occurred and it is desired to rethread the reel spool. In such a situation, not only is the reel spool location in opposition to the point on the reel drum where threading is initiated, but the threading of the spool must often be accomplished through a restricted space formed by the reel drum and another reel spool placed in standby or pre-windup position. Thus, not only must the threaded web pass around the curved surface of the reel drum, it must pass through a restricted opening while doing so. In the past, two principal approaches have been applied in the art of reel threading. The first calls for the utilization of ropes which pass about the periphery of the reel drum near the edge thereof. The operator, when threading, places the web in the rope nip which, in theory at least, results in the web being carried about the periphery of the drum to the location of the spool to be threaded. This procedure is, however, quite dangerous since the tensioned rope can break and additionally the operator can get his hand caught when initially inserting the web in the rope nip.

The other primary prior art approach has been to employ a series of air jet nozzles, often hand-held, about the periphery of the reel drum. Through manipulation of the air jets an attempt is made to keep the web on the reel drum until it reaches the vicinity of the spool. This air blast technique is quite unsatisfactory since it often calls for several people to aim the air at the web at various locations in an attempt to keep the web in a desired path of movement. What often results, however, is essentially uncontrolled web movement, especially lateral movement, and a great deal of time frequently goes by before the web is finally directed to the vicinity of the reel spool. The use of conventional air nozzles to effect reel threading becomes an especially difficult task when lighter weight paper grades, such as tissue, are to be threaded since these lighter grades, unless kept under tension at all times, tend to bunch up and jam at any restricted openings through which the web must pass.

In addition to the aforedescribed rope threading and air blast threading techniques, it is not uncommon for operators to attempt to thread slower machines through guidance of the web by hand about the periphery of the reel drum. Needless to say, this practice is highly undesirable and can easily result in injury to the person or persons attempting hand threading.

The present invention provides a system of relatively inexpensive and simple construction which utilizes the phenomenon known as the "Coanda effect" to entrain a moving web of flexible material and quickly direct same along the curved surface of a reel drum to the vicinity of a cooperating reel spool about which the web is to be wound without the necessity of manual manipulation.

SUMMARY OF THE INVENTION

The present invention relates to a threading means and method for use in a web reel system including a rotatable reel drum having a cylindrically-shaped outer surface, and a rotatable reel spool for receiving web material from the drum and selectively movably mounted to transverse a generally radial path relative to the spool between a start-up position wherein the drum is disposed generally vertically over the drum and forms a nip therewith and a web winding position wherein the spool is disposed generally horizontally relative to the drum with a nip formed between the drum surface and the outermost layer of web material wound about the spool. The threading means includes at least one Coanda nozzle adapted to induce a gaseous flow about the periphery of the drum for entraining a web introduced into the gaseous flow and directing same between the drum and the spool. A threading chute including a first wall and a dependent second wall leads from the Coanda nozzle toward the drum surface and the first wall defines a gap with the drum surface through which the gaseous flow from the Coanda nozzle passes. The second wall extends substantially at right angles to the first wall and adjacent to a drum end wall. Means are provided for adjusting the size and cross-sectional profile of the gap formed between the threading means first wall and the drum surface.

BRIEF DESCRIPTION OF THE DRAWINGS

The preferred embodiment of the present invention is illustrated in the accompanying drawings in which.

GENERAL DESCRIPTION

Figure 1:
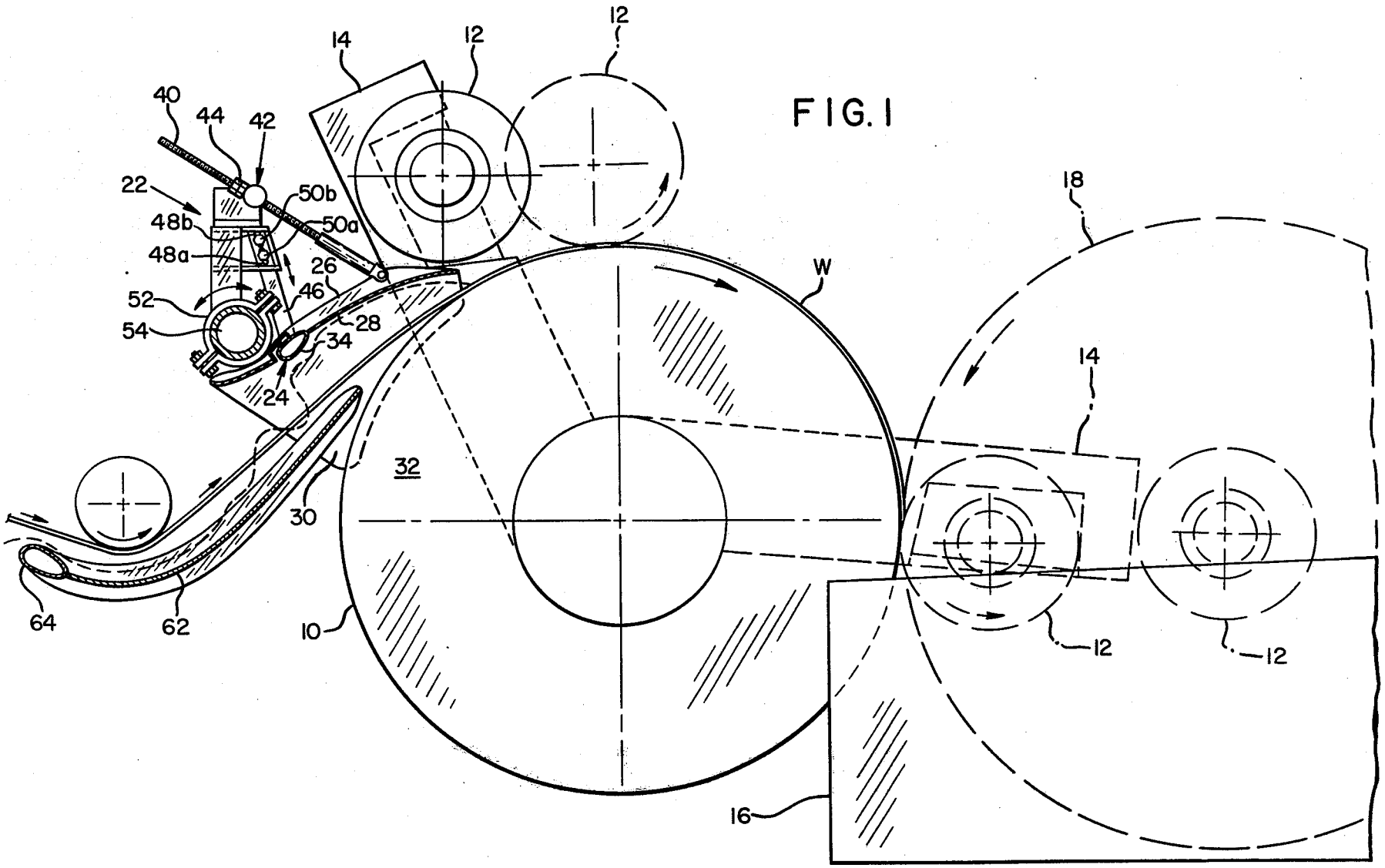
FIG. 1 is a schematic side view illustrating apparatus constructed according to the present invention.

FIG. 1 illustrates in schematic fashion a typical reel end arrangement of the type found for example at the terminal end of paper machines or the like for winding web material thereabout. Typically included in such an arrangement are a reel drum 10 having a cylindrically-shaped outer surface and a rotatable reel spool 12 for receiving material from the drum. The reel spool 12 is mounted for rotatable movement in a reel yoke 14. Since yokes and their operation are conventional in reel systems the member 14 will not be described in detail. For the purposes of the present invention it is only necessary to know that a suitable mechanism is employed to rotate the yoke 14 relative to reel drum 10 from the position indicated by solid lines to that noted in phantom. In the solid line position, yoke 14 maintains spool 12 in a pre-windup position wherein the spool is disposed over the drum 10 and spaced therefrom a predetermined distance. Rotational movement of yoke 14 brings spool 12 into the illustrated phantom line position wherein the spool is disposed generally vertically over the drum and forms a nip therewith, said position being hereinafter referred to as the start-up position. A web introduced into the nip formed between the drum and the spool when the spool is in the start-up position will be wound about the spool in the usual fashion. Such winding continues after start-up and while the yoke continues to move toward the location shown in phantom whereat it finally comes to rest with the spool rotatably disposed on a suitable support such as that indicated schematically and designated by reference numeral 16. The spool continues to rotate on the support and have sheet material wound thereabout until a full reel of wound material is developed or built up as illustrated in the phantom line position occupied by the fully wound spool and which is designated by reference numeral 18.

While the winding of the spool 12 continues upon support 16, the yoke 14 is disengaged therefrom, rotated, and a new spool rotatably-mounted thereon in the aforedescribed pre-windup position. The web which is being wound about the spool resting on support 16 passes through the gap formed between the spool that is now in the pre-windup position and the drum. In a typical arrangement such gap will be no more than ½ to 2 inches. This restricted opening presents difficulties in the event a break occurs during the reel buildup operation since to complete the reel it is necessary to rethread the moving web of material through the gap formed between drum 10 and the spool 12 in pre-windup position, and thence about the periphery of the drum to the vicinity of the nip formed between the drum and the partially completed reel formed on the spool in web winding position.

In the prior art, such rethreading was typically effected by introducing a web into a nip formed between the ropes passing about the periphery of the drum near the edge thereof. The rope nip then delivers the web to the location of the partially threaded reel. Such a procedure is, however, quite complicated and dangerous. Tensioned ropes can break and the rope nip is additionally rather dangerous insofar as the operator is concerned since it is very easy for one to get one's hand caught therein.

Air jet nozzles of conventional construction, often hand-held, have also been used in the prior art to rethread a reel. Usually this procedure is quite time-consuming and it often calls for several people to attempt to direct the web to the partially wound reel location. Passage of the web through the gap between the drum and the spool in pre-windup position is especially difficult since conventional air blast techniques result in essentially uncontrolled web movement, especially lateral movement. In addition, the web passing through the gap may tend to follow the surface of the spool in pre-windup position rather than the periphery of the reel drum. This results in still another location whereat the operator or his assistants are required to direct an air blast toward the web to maintain it in position on the drum surface.

The present invention provides a system of relatively inexpensive and simple construction which utilizes the phenomenon known as the "Coanda effect" to entrain a moving web of flexible material and direct same along the curved surface of a reel drum to the vicinity of a cooperating reel spool about which the web is to be wound. As described in detail below, the threader system of the present invention may be controlled by a single operator and very quickly results in the desired rethreading function. Time is of course of the essence when threading since valuable production is lost until it takes place. The present invention may be utilized to thread a spool in start-up position, the web windups position, or any position therebetween, regardless of whether or not a spool is in pre-windup position.

Threading apparatus constructed in accordance with the present invention is designated generally by reference numeral 22. Apparatus 22 includes a Coanda nozzle 24 and a threading chute 26 leading from the Coanda nozzle toward the drum surface. The threading chute 26 includes a first wall 28 defining a gap with the drum surface and a second wall 30 extending downwardly substantially at right angles from the first wall and adjacent to an end wall 32 of drum 10. First wall 28 is preferably curved on either side of nozzle 24, downwardly downstream from the nozzle and upwardly upstream thereof to form a bell-shaped cross section with the curved drum surface.

Figure 3:
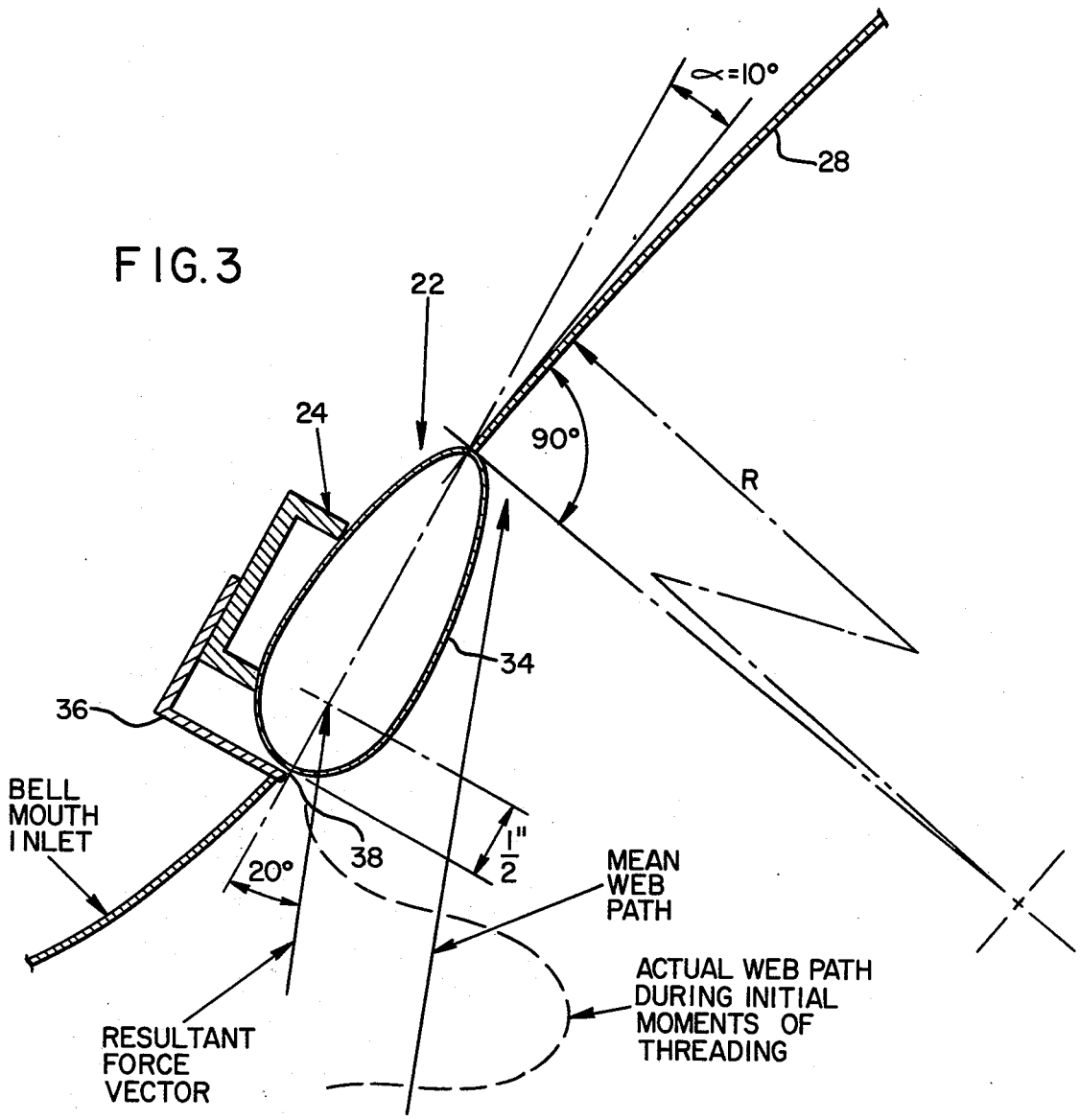
FIG. 3 is a shcematic side view illustrating details of the Coanda nozzle employed in the construction of the present invention and its positioning.

Referring now to FIG. 3, it may be seen that Coanda nozzle 24 includes a foil element 34 and a bracket member 36 defining with the foil element 34 a restricted linear slit or orifice 38 through which pressurized gas is directed. Coanda nozzle 24 is of the same construction as those illustrated in the aforesaid U.S. Pat. Nos. 3,999,696 and 4,014,487 and the construction and operation thereof will not be described in detail other than to state that the pressurized gas being emitted through slit 38 attaches to the surface of foil element 34 due to the "Coanda effect" and flows therealong with entrained ambient air along the downstream portion of first wall 28 toward the upper drum surface, i.e. to the right as shown in FIG. 3.

Referring once again to FIG. 1, means is provided for adjusting the size and cross-sectional profile of the gap defined by first wall 28 and the outer cylindrical surface of drum 10. In the illustrated preferred embodiment of the apparatus 22 such means includes a rod 40 slidably mounted in an aperture formed in support member 42. Rod 40 is dimensioned so as to be freely movable in the aperture and downward movement of the rod is prevented by an adjustment nut 44 adjustably threaded to the rod. The lower end of the rod is pivotally attached to threading apparatus 22 in any desired manner. A further component of the adjustment means is a support arm 46 which has two slots **48*a* and 48*b* formed at the upper end thereof. Bolts 50*a* and 50*b* pass through the slots 48*a* and 48*b* and are threadably engaged with support member 42. By loosening the bolts 50*a* and 50*b*, support arm 46 may be adjustably moved up or down and secured in the desired position by tightening down the bolts. The final adjustment component is a split clamp 52 which is rigidly connected to support member 42. Adjustment nuts and bolts are provided on either side of split clamp 52 in the well-known manner to allow for the radial adjustment of support member 42 about a cylindrical element 54** which is fixedly mounted to a paper machine wall or the like (not shown). Thus, the adjustment mechanism employed with the threader enables three types of adjustment to be made. As will be seen below such adjustability is an important factor as far as the operation of the present device is concerned to obtain the desired results.

The function of the disclosed threading apparatus is to receive a moving web of flexible material such as paper and deliver it to the spool about which it is to be wound. This is accomplished by passing a pressurized gas such as air through slit 38 of the Coanda nozzle 24 thus creating a flow of such pressurized gas and ambient air entrained thereby along the outer surface of the nozzle foil element 34 and along first wall 28. The threading apparatus 22 is so positioned relative to drum 10 that the combined gaseous flow exiting from the terminal end of first wall 28 attaches itself to the cylindrical outer surface of the drum due to the Coanda effect and flows in a circular path about the drum surface to the vicinity of the spool which is to have the web material wound thereabout. The web which is to be threaded is then directed to the immediate vicinity of the Coanda nozzle 24 by the operator so that it is entrained by the moving gaseous flow and follows the gaseous flow path to the vicinity of the spool. This may be accomplished directly or by employing a supplemental feeder chute and Coanda nozzle such as chute 62 and Coanda nozzle 64 shown in FIG. 1 which throw the web to nozzle 24. In FIG. 1, a web W is shown in solid lines, being delivered by the threading apparatus about drum 10 to the vicinity of a spool in web winding position from the phantom line position wherein it is introduced to the threader system. Such operation may be carried out extremely rapidly and without the need of supplemental assistance by additional personnel or auxiliary air jets to direct the web to its desired location. Once the web reaches the vicinity of the spool, it is of course taken up and wound thereabout in the usual fashion.

Figure 2:
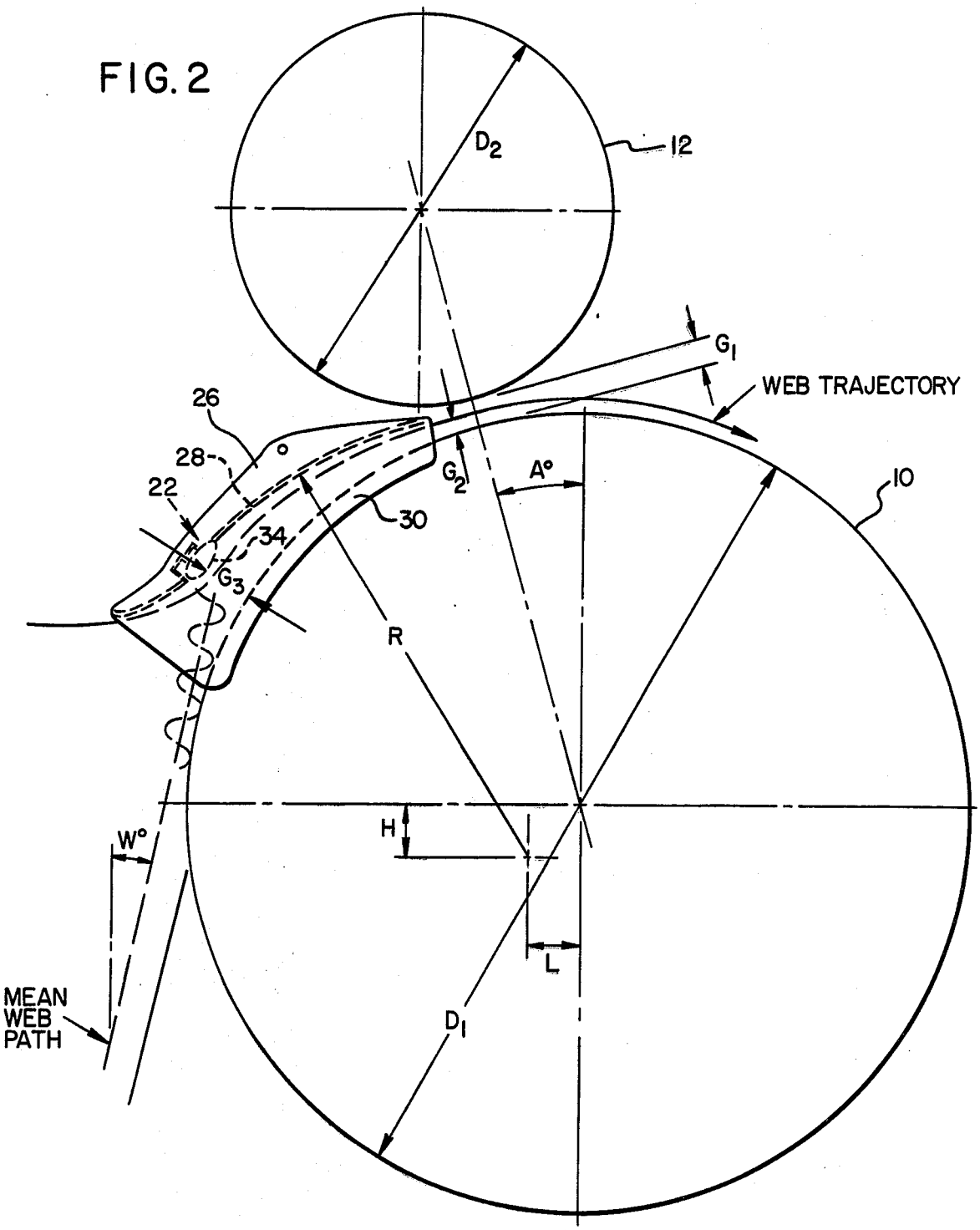
FIG. 2 is a schematic side view illustrating specific details of components of the present invention with a spool shown in pre-windup position relative to a drum.

The positioning and geometry of the threading apparatus relative to the rest of the reel system are very important considerations insofar as the operability of the device is concerned. It will be appreciated that these characteristics will change between particular installations since operational characteristics of the installations themselves, as well as the materials they produce, vary widely. There are however some basic principles that should be adhered to in all instances. With particular reference to FIGS. 2, which shows a second wall 30 of slightly different configuration from that in FIG. 1 and adjacent to the drum side wall facing the viewer, and 3, the basic rules are as follows:

1. The curvature R of the first wall 28 should be equal to the radius of the reel drum plus an additional incremental amount. Approximately 3" has been found to be a suitable additional incremental amount. This provides for a broad range of gap $G_2$ and $G_3$ adjustments. Through adjustment of the chute its center of curvature becomes offset from center of drum 10 by a predetermined horizontal distance L and a predetermined vertical distance H.

2. In the event a feeder chute such as that shown in FIG. 1 and identified by reference numeral 62 is utilized, the width of threading chute 26 should be equal to the width of the feeder chute (which may, for example, be in the order of 12" or so when threading a reduced width web) plus the distance from the inside edge of first wall 28 to the edge of the reel drum. Second wall 30 must be wide enough to seal the gap between first wall 28 and the reel drum. These features prevent the web from leaving the reel drum and wrapping around the drum shaft.

3. Threading chute 26 preferably includes a bell-mouthed entry to prevent web hangup on the Coanda nozzle 24.

4. The threading chute 26 should be mounted so as to provide accurate stops for adjustment of gaps $G_2$ and $G_3$. Hinge arrangements should preferably be provided between rod 40 and support arm 46 and the first wall to permit automatic, rapid opening of gap $G_2$ in the event of plugging.

5. The downstream tip of chute 26 should be positioned so as to protrude as far as possible into the open nip $G_1$ defined by a spool in pre-windup position and the reel, without of course unduly restricting the size of the gap $G_2$ opening.

6. The threading apparatus should be positioned such that the mean path of the web being projected thereto is aimed at a point downstream from the trailing edge of the nozzle if a single nozzle is used, and between the nozzles if two nozzles are used. The length of the chute and the nozzle position are determined by the incoming web trajectory and the gap $G_3$. For a given chute length, the gap $G_3$ is adjusted so that the resultant forces that are produced by the suction of the nozzle are at a slight acute angle relative to the mean web trajectory during threading. The direction of the force vector relative to the chord of the nozzle depends on the nozzle's geometry. For example, the nozzle shown in FIG. 3 having a slit at the leading edge center line and with a bell-mouthed inlet generates a resultant force vector at approximately 20° from the nozzle chord line. The nozzle is set at a 10° angle relative to the tangent of the arc formed by the chute first wall 28. These details are shown in FIG. 3.

It will be appreciated that some "fine tuning" must be made in individual situations to ensure proper operation of the present device. The primary objective of inducing a Coanda flow about the reel drum must be kept in mind and the threading chute must be appropriately adjusted to ensure that the Coanda attachment takes place on the drum rather than on any spool that is in the pre-windup position. One does not wish to place the induced air stream too close to the spool so as to cause flow attachment thereto. To ensure flow attachment to the drum, gap $G_2$ must be sufficiently small to create a space between the spool and first wall 28 sufficient to prevent attachment to the spool but large enough to prevent plugging. In addition, flow attachment to the spool may occur if the chute is inclined thereto to too great a degree, i.e. $G_3$ becomes too small, and this is to be avoided.

From basic studies of Coanda-type flows it is known that flow attachment from a jet at right angles to a curved surface is difficult to attain if the ratio of the radius of curvature ($R_c$) over the jet thickness or the gap ($G_2$) is less than 5. For small values of $R_c/G_2$, attachment can occur however if the jet is inclined in the direction of flow (towards the surface). To ensure flow attachment to the reel drum rather than to the spool, the adjustments of $G_2$ and $G_3$ become more critical for reels with large diameter spools, spools at large backwards displacement from the drum center line (angle A) or a combination of both.

Additional factors that should be considered are the machine speed and the grade of material produced. These will determine the minimum permissible gap $G_2$, and sensitivity of the web trajectory to gap $G_3$ and force vector orientation.

EXAMPLE I

The following table sets forth the dimensional characteristics of a web threading system constructed according to the teachings of the present invention that has been installed. As mentioned above, it will be appreciated that dimensional requirements vary with each paper machine or other equipment wherein installations are made:

TABLE I

| | |
|---|---|
| Reel Drum Diameter, $D_1$ - inches | 48 |
| Spool Diameter, $D_2$ - inches | 24 |
| Radius of Curvature for Chute Pan R ($R = \frac{1}{2} D_1 + 3''$) - inches | 27 |
| Vertical Offset of the Center of Curvature, H - inches | 3 |
| Horizontal Offset of the Center of Curvature, L - inches | $3\frac{1}{2}°$ |
| Spool Offset Angle A° | $15\frac{1}{2}°$ |
| Web Entry Angle W° | 13 |
| Width of the Open Nip G - inches | $1\frac{3}{8}$ |
| Width of the Air Gap at Chute Exit, $G_2$ - inches | 1 |
| Width of the Chute Entrance Gap, $G_3$ - inches | $2\frac{3}{8}$ |

I claim:

1. In a web reel system including a rotatable reel drum having a cylindrically-shaped outer surface, and a rotatable reel spool for receiving web material from said drum and selectively movably mounted relative to the drum between a start-up position wherein the spool forms a nip with the drum, and a web winding position wherein the spool is spaced from the drum and web material wound about said spool, the improvement comprising reel threading means operatively associated with said spool and drum, said threading means including at least one Coanda nozzle adapted to induce a gaseous flow about the periphery of said drum for entraining a web introduced into said gaseous flow and directing same between said drum and said spool.

2. The combination according to claim 1 wherein a threading chute leads from said Coanda nozzle and defines a gap with said drum surface.

3. The combination according to claim 2 wherein said threading chute includes a first wall curved toward said drum surface to form said gap, said Coanda nozzle positioned relative to said first wall to direct said gaseous flow through said gap.

4. The combination of claim 3 wherein said threading chute additionally includes a second wall extending substantially at right angles from said first wall and adjacent to a drum end wall.

5. The combination of claim 2 additionally comprising means for adjusting the size and cross-sectional profile of said gap.

6. The combination of claim 3 wherein said spool is selectively movably mounted relative to the drum so as to be disposed in a pre-windup position wherein the spool is disposed over the drum but spaced therefrom a predetermined distance, said chute first wall adapted for movement between said spool and said drum when said spool is in said pre-windup position.

7. A method of threading a web reel assembly including a reel drum having a cylindrical outer surface and a reel spool comprising:

positioning a Coanda nozzle adjacent to said drum, said Coanda nozzle having a fluid flow exit slit;

flowing a pressurized gas through the nozzle exit slit so that a gaseous flow is induced thereby and directed adjacent to said cylindrical drum surface through a gap defined by said cylindrical drum surface and a wall extending from said Coanda nozzle, said gap being of a size and configuration such that a significant portion of said gaseous flow attaches to said cylindrical drum surface and flows thereabout due to the Coanda effect; and entraining a web in the gaseous flow so that the web is directed about said drum to the vicinity of said spool.

* * * * *